United States Patent [19]

Van Kempen et al.

[11] 4,173,927

[45] Nov. 13, 1979

[54] PRINTING DEVICE

[75] Inventors: Dick Van Kempen, Eindhoven; Marius Quirijnen, Zoetermeer, both of Netherlands

[73] Assignee: U.S. Philips Corporation, New York, N.Y.

[21] Appl. No.: 935,895

[22] Filed: Aug. 22, 1978

Related U.S. Application Data

[63] Continuation of Ser. No. 780,962, Mar. 24, 1977, abandoned.

[30] Foreign Application Priority Data

Apr. 1, 1976 [NL] Netherlands ..... 7603373

[51] Int. Cl.[2] ..... B41J 7/92

[52] U.S. Cl. ..... 101/93.03; 400/56; 400/57

[58] Field of Search ..... 101/93.03, 93.27–93.34, 101/93.48, 407 BP, 93.14; 400/55, 56, 57

[56] References Cited

U.S. PATENT DOCUMENTS

| | | | |
|---|---|---|---|
| 3,172,353 | 3/1965 | Helms | 101/93.03 X |
| 3,981,235 | 9/1976 | Thomas et al. | 400/56 |
| 4,002,118 | 1/1977 | Washimine | 101/93.03 X |
| 4,010,834 | 3/1977 | Linden | 101/93.03 X |

FOREIGN PATENT DOCUMENTS

| | | | |
|---|---|---|---|
| 475890 | 1/1968 | Japan | 101/93.03 |

OTHER PUBLICATIONS

Bear et al., IBM Tech. Discl. Bulletin, vol. 5, No. 11, 4/1963, pp. 27–29.

*Primary Examiner*—Edward M. Coven
*Attorney, Agent, or Firm*—Robert S. Smith

[57] ABSTRACT

A printing device in which a roll having a plurality of characters disposed thereon is displaceable with respect to at least one printing hammer. The printing hammer cooperates with a coil which, when excited, generates a field which by cooperation with a stationary field, puts the hammer into motion and drives it against the character on the roll to be printed. The hammer is arranged to be movable in the device so that the distance between the hammer and the roll is adjustable. A control device is provided which measures the hammer flying time and compares this time with a nominal flying time and which, in the case of a difference, displaces the hammer relative to the roll and also changes the driving force of the hammer.

3 Claims, 1 Drawing Figure

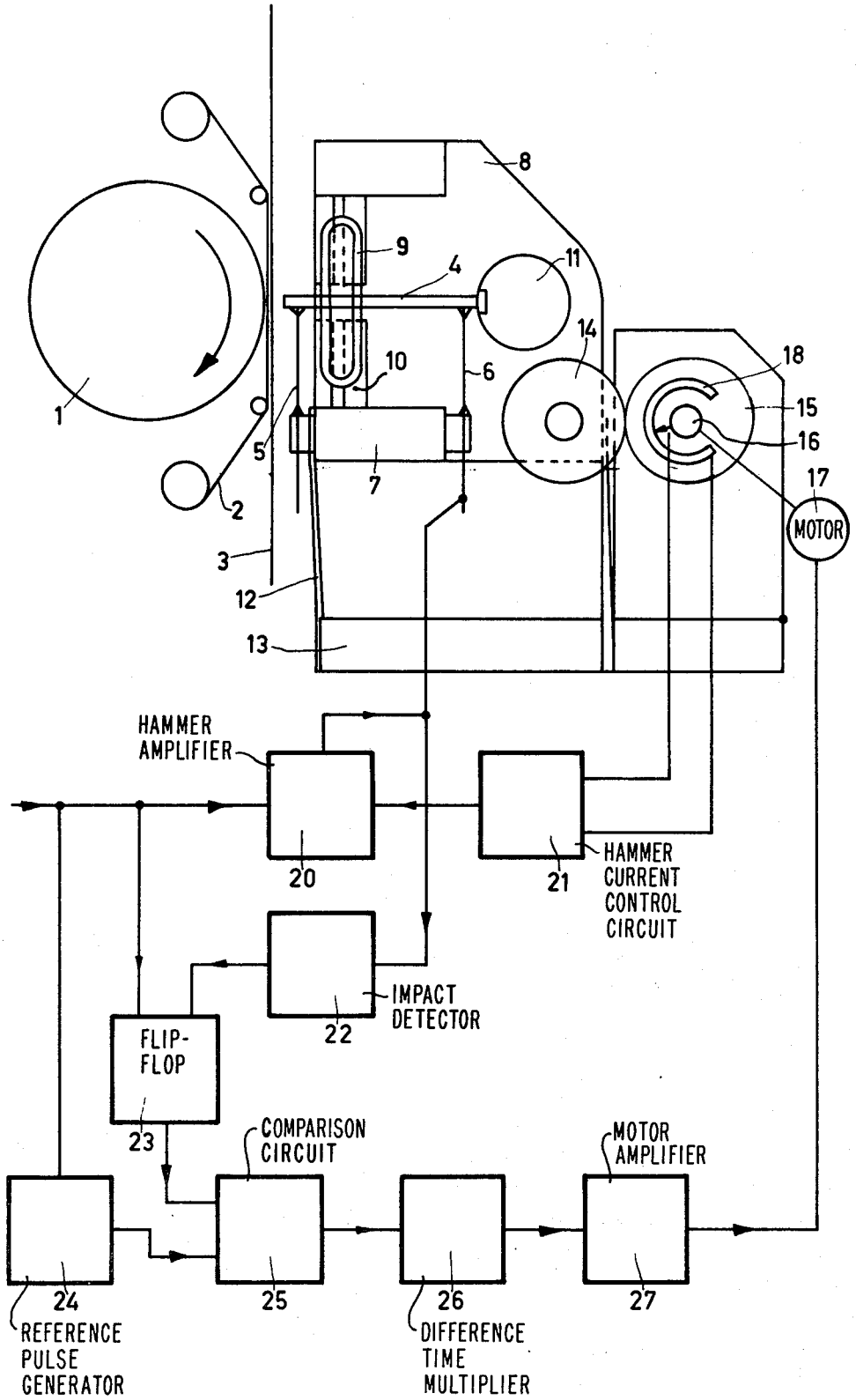
1
2
3
4
5
6
7
8
9
10
11
12
13
14
15
16
17
18
MOTOR
HAMMER AMPLIFIER
20
21
HAMMER CURRENT CONTROL CIRCUIT
IMPACT DETECTOR
22
FLIP-FLOP
23
COMPARISON CIRCUIT
MOTOR AMPLIFIER
24
25
26
27
REFERENCE PULSE GENERATOR
DIFFERENCE TIME MULTIPLIER

PRINTING DEVICE

This is a continuation, of application Ser. No. 780,962, filed Mar. 24, 1977, now abandoned.

The invention relates to a printing device, in which a roll on which the printing characters are provided can be moved along at least one printhammer which carries a coil which, when excited, generates a field which puts the hammer into motion by cooperation with a stationary field, the hammer then striking the printing character to be printed, the current which is applied to the coil being controllable.

A printing device of the kind which forms the subject of the present invention is described in the published Netherlands Pat. application No. 64 04 269. The printing hammers of devices of this kind are usually combined to form a hammer band opposite a roll, on the surface of which several sets of printing characters are provided in circular paths or trajectories. Between the roll and the hammers an ink ribbon is provided, while a paper strip consisting of one or more layers can be transported between this ribbon and the hammers. Printing is effected in that each hammer is actuated at the appropriate instant, so that it starts to move and strikes the paper and presses the paper, together with the ink ribbon, against the drum at the instant at which the character to be printed is situated opposite the hammer.

Because it is desirable that the characters are all printed at the same level on the paper, each hammer should strike the paper at an instant at which the characters on the drum are in a given, fixed relative position. In the known device this is achieved by keeping constant the flying time, i.e. the time expiring between the start of the actuation of the hammer and the striking of the drum. However, if use is made of paper consisting of a plurality of layers in order to obtain a number of copies, the distance between the hammer and the paper changes, so that the flying time also changes, with the result that the characters are printed in a position other than, for example, in the case of mono-layer paper.

Furthermore, in order to otain properly legible copies, it is also desirable for the striking of the hammer to increase as the layer thickness increases.

The invention has for its object to provide a device of the kind set forth in which the two said problems are solved in a comparatively simple manner.

The printing device in accordance with the invention is characterized in that the hammer is arranged to be positionable in the device so that the distance between the hammer, in the non-actuated condition, and the roll is adjustable, a control device being provided which measures the hammer flying time, compares this time with a nominal flying time and, in the case of a difference, displaces the hammer relative to the roll, and also changes the driving force of the hammer so that, in the case of displacement of the hammer in the direction away from the roll, the actuation increases in accordance with a predetermined pattern and vice versa.

A preferred embodiment of the device in accordance with the invention is characterized in that the hammer is arranged in a hammer bank which is disposed on leaf springs and which supports a roller which cooperates with a cam disc, the shaft of which is coupled to a drive and to a potentiometer which controls the hammer actuation, the drive being controlled by the said control device, the profile of the cam disc and the potentiometer being adapted to each other so that, when the distance between the hammer and the roll increases, the actuation of the hammer also increases, so that the flying time remains constant.

When paper in the form of a plurality of layers is fed into the device in accordance with the invention, the flying time, i.e. the time expiring between the start of the actuation and the striking against the paper, initially decreases. This is measured by the control device which compares the actual flying time with an adjusted nominal flying time. Depending on the magnitude of the difference, the drive is actuated to rotate the cam disc, so that the distance between the hammer and the roll is increased, and at the same time the actuation is increased by rotation of the potentiometer so that the same flying time is obtained again, be it with a stronger actuation. As a result, the hammer again strikes the roll and hence the character to be printed at the correct instant, so that the print is again positioned at the correct level on the paper. Furthermore, it is achieved that all copies are properly legible as a result of the stronger actuation.

The invention will be described in detail hereinafter with reference to the drawing which diagrammatically shows a printing device (not to scale).

The reference 1 in the drawing denotes a character roll. The surface of this roll is provided with a number of circular paths or, trajectories each of which comprises a series of printing characters in relief. The roll 1 rotates in the direction of the arrow. Opposite the surface of the roll there is situated an ink ribbon 2, behind which the paper 3 to be printed is situated. Opposite the paper a number of printing hammers 4 are arranged. Each of these printing hammers is supported by two parallel leaf springs 5 and 6, the other end of which is connected to a bar 7 which is rigidly connected to the hammer bank construction 8. On each hammer 4 there is provided a coil 9, the connection terminals of which are connected to the leaf springs 5 and 6, respectively. The coil 9 is movable in an air gap between two permanent magnets 10, having opposite polarity, which are rigidly connected to the hammer bank 8. When current is applied to the coil 9, the coil tends to move between the poles of the magnets towards the paper. When the coil is actuated at the correct instant, the hammer is moved, so that the paper is pressed against the desired character. The rear of the hammer rests against an abutment 11 in the rest condition.

The hammer array 8 is arranged on a number of parallel leaf springs 12, the other end of which is secured to a base plate 13. The hammer array furthermore supports a cam roller 14 which cooperates with a cam disc 15.

The cam disc 15 is mounted on a shaft 16 which is coupled to a drive 17, for example, an electric motor, and potentiometer 18.

The printing device is also provided with a control device which comprises:

- a hammer amplifier 20 which provides electrical power to the hammer for actuation;
- a hammer current control circuit 21 which controls the actuation force of the hammer;
- an impact detector 22 which registers the instant at which the hammer strikes the paper;
- a flipflop 23 which measures the difference between the start of the hammer actuation and the strike, i.e. the flying time;

a reference pulse generator 24 which supplies a fixed reference signal which corresponds to the nominal flying time;

a comparison circuit 25 in which the actual flying time is compared with the nominal flying time, and which supplies a difference signal to a difference time multiplier 26 which supplies a signal to a motor amplifier 27 which controls the motor 17.

The operation of the device is as follows. The hammer bank 8 can be selectively displaced a predetermined distance from the roll 1 by rotation of the cam disc 15. The curve of the cam disc 15 and the potentiometer are chosen so that for each thickness (i.e. the number of layers) of the paper 3 a constant flying time of the hammer is obtained and also an impact force which is obtained that is adequate to provide a proper print on each layer of paper.

When a paper strip having a given thickness is introduced, the flipflop 22 will measure a given flying time during the first hammer actuation. The measured flying time is compared by the comparison circuit 25 with the nominal flying time supplied by the reference pulse generator. The resultant difference signal from the comparison circuit is multiplied by the difference time multiplier 26. The product of this multiplier is applied to the motor amplifier 27 which suitably actuates the motor 17 to rotate shaft 16, the cam disc 15, and the potentiometer 18 wiper a predetermined angular travel which is a function of the magnitude of the product of the multiplication referred to above. the predetermined angular travel of the cam disc 15 and potentiometer 18 wiper results respectively in a distance variation between the hammer 4 and the roll 1, and also in a signal to the hammer current control circuit whereby the degree of actuation of the hammer is varied in a corresponding manner, i.e. increased actuation for an increasing distance and vice versa.

The components 20–27 of the control device are shown in the form of a block diagram and concern circuits which are well known per se. It will be obvious from the foregoing that the invention provides a printing device which automatically adapts itself to the thickness of the paper to be printed, the flying time being kept constant and the hammer actuation being suitably adapted.

What is claimed is:

1. A printing device for printing images on an associated record carrier having at least one layer which comprises: a roll on which a plurality of printing characters are disposed, at least one printing hammer, means mounting said roll for relative motion with respect to said one printing hammer, means for holding the record carrier proximate to said roll, means biasing said hammer away from the record carrier to a first position, a coil cooperating with said one hammer which when excited generates a field which urges said one hammer toward a printing character on said roll and to impact said record carrier in a second position, means for varying the current through said coil, means for mounting said one hammer to be movable so that the distance between (1) said one hammer in the non-actuated condition, and (2) the roll is adjustable, means for providing a fixed reference time signal corresponding to the nominal hammer flying time, said nominal flying time being the time from said first position to said second position with said record carrier having a given number of layers and which produces images in the desired location which are legible, means for measuring actual flying time of said one hammer, means for comparing actual flying time of said one hammer with said fixed reference signal and, means for displacing said one hammer relative to said roll and changing the impact force responsive to a difference between said signal corresponding to nominal hammer flying time and actual flying time for said one hammer.

2. A printing device as claimed in claim 1 wherein said one hammer is spring mounted, said means for mounting including a cam disc cooperating with said one hammer, a shaft fixed to said cam disc, said means for varying the current through said coil including a potentiometer cooperating with said shaft.

3. A printing device as claimed in claim 1 wherein said device further includes a plurality of additional hammers.

* * * * *